US012357021B2

(12) United States Patent
Abi Aoun et al.

(10) Patent No.: US 12,357,021 B2
(45) **Date of Patent: *Jul. 15, 2025**

(54) AEROSOL GENERATION

(71) Applicant: NICOVENTURES TRADING LIMITED, London (GB)

(72) Inventors: Walid Abi Aoun, London (GB); Sally Bell, London (GB)

(73) Assignee: NICOVENTURES TRADING LIMITED, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 18/641,847

(22) Filed: Apr. 22, 2024

(65) Prior Publication Data

US 2024/0268457 A1 Aug. 15, 2024

Related U.S. Application Data

(63) Continuation of application No. 17/420,645, filed as application No. PCT/EP2019/086700 on Dec. 20, 2019, now Pat. No. 12,102,121.

(30) Foreign Application Priority Data

Jan. 4, 2019 (GB) ..... 1900128

(51) Int. Cl.
*A24F 40/30* (2020.01)
*A24B 15/167* (2020.01)
(Continued)

(52) U.S. Cl.
CPC ..... *A24F 40/30* (2020.01); *A24B 15/167* (2016.11); *A24F 40/10* (2020.01); *A24F 40/42* (2020.01)

(58) Field of Classification Search
CPC ..... A24F 40/30; A24F 40/10; A24B 15/167
(Continued)

(56) References Cited

U.S. PATENT DOCUMENTS 4,284,089 A 8/1981 Ray
4,846,199 A 7/1989 Rose
(Continued)

FOREIGN PATENT DOCUMENTS

EP 2399637 A1 12/2011
EP 3 251 529 12/2017
(Continued)

OTHER PUBLICATIONS

International Search Report and Written Opinion for PCT/EP2019/086700 date mailed Apr. 17, 2020; 8 pages.
(Continued)

*Primary Examiner* — Gary F Paumen
(74) *Attorney, Agent, or Firm* — WOMBLE BOND DICKINSON (US) LLP

(57) ABSTRACT

A device for generating an inhalable medium, the device comprising: a container retaining a first volatilizable material; a heater for volatilising the first volatilizable material held in the container; a chamber containing aerosolizable material comprising nicotine; g reservoir containing a basic solution; and an outlet; the arrangement being such that in use, the basic solution is released from the reservoir and enters the chamber containing the aerosolizable material, and the first volatilizable material is volatilized by the heater to form a vapor and/or an aerosol, which passes through the chamber containing aerosolizable material and entrains one or more constituents of the aerosolizable material, thereby forming an inhalable medium which passes through the outlet.

19 Claims, 1 Drawing Sheet

(51) Int. Cl.
*A24F 40/10* (2020.01)
*A24F 40/42* (2020.01)

(58) Field of Classification Search
USPC ..... 131/329
See application file for complete search history.

(56) References Cited

U.S. PATENT DOCUMENTS

| | | | |
|---|---|---|---|
| 4,848,374 | A | 7/1989 | Chard et al. |
| 4,907,606 | A | 3/1990 | Lilja et al. |
| 5,105,834 | A | 4/1992 | Saintsing et al. |
| 6,234,167 | B1 | 5/2001 | Cox et al. |
| 8,356,606 | B2 | 1/2013 | Sengupta et al. |
| 12,102,121 | B2 * | 10/2024 | Abi Aoun ..... A24F 40/42 |
| 2012/0006342 | A1 | 1/2012 | Rose et al. |
| 2012/0312314 | A1 | 12/2012 | Plakidis et al. |
| 2013/0160779 | A1 | 6/2013 | Chida et al. |
| 2013/0160780 | A1 | 6/2013 | Matsumoto et al. |
| 2014/0261488 | A1 | 9/2014 | Tucker |
| 2014/0261491 | A1 | 9/2014 | Hawes |
| 2014/0283855 | A1 | 9/2014 | Hawes et al. |
| 2015/0020822 | A1 | 1/2015 | Janardhan et al. |
| 2016/0021931 | A1 | 1/2016 | Hawes et al. |
| 2016/0205992 | A1 | 7/2016 | Bell et al. |
| 2016/0235121 | A1 | 8/2016 | Rogan et al. |
| 2017/0042245 | A1 | 2/2017 | Buchberger et al. |
| 2017/0172212 | A1 | 6/2017 | Phillips et al. |
| 2017/0251727 | A1 | 9/2017 | Nielsen |
| 2017/0319799 | A1 | 11/2017 | Yamada et al. |
| 2017/0340018 | A1 | 11/2017 | Thorens |
| 2017/0347706 | A1 | 12/2017 | Aoun et al. |
| 2018/0027882 | A1 | 2/2018 | Hepworth et al. |
| 2018/0035719 | A1 | 2/2018 | Turner et al. |
| 2018/0049477 | A1 | 2/2018 | Suzuki et al. |
| 2018/0146711 | A1 | 5/2018 | Mazur et al. |
| 2018/0279666 | A1 | 10/2018 | Abi Aoun et al. |
| 2018/0279667 | A1 | 10/2018 | Mcadam et al. |
| 2018/0279678 | A1 | 10/2018 | Hepworth et al. |
| 2018/0343920 | A1 | 12/2018 | Sutton et al. |

FOREIGN PATENT DOCUMENTS

| | | | |
|---|---|---|---|
| KR | 10 2015 0129683 | | 11/2015 |
| KR | 2018 0111460 | | 10/2018 |
| WO | 2007/054167 | A1 | 5/2007 |
| WO | 2011/034723 | A1 | 3/2011 |
| WO | 2014140320 | | 9/2014 |
| WO | 2016/050244 | A1 | 4/2016 |
| WO | 2016/079729 | A1 | 5/2016 |
| WO | 2018/033649 | A1 | 2/2018 |

OTHER PUBLICATIONS

Canadian Office Action from CA Application No. 3,124,606, mailing date of Sep. 29, 2022; 5 pages.

KR Office Action from KR Application No. 10 2021 7024437, mailing date of Apr. 13, 2023; 6 pages (with English Translation 6 pages).

* cited by examiner

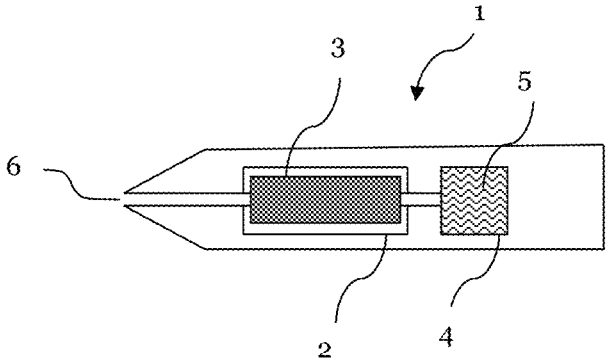
1
3
5
6
2
4

AEROSOL GENERATION

CROSS-REFERENCE TO RELATED APPLICATIONS

This application is a continuation of U.S. patent application Ser. No. 17/420,645, filed Jul. 2, 2021, which is a National Stage Entry of PCT Application No. PCT/EP2019/086700, filed Dec. 20, 2019, which claims priority from GB Patent Application No. 1900128.8, filed Jan. 4, 2019, each of which is hereby fully incorporated herein by reference.

TECHNICAL FIELD

The present invention relates, without limitation, to a device for generating an inhalable medium, a cartridge for use in a device for generating an inhalable medium, and a kit.

BACKGROUND

Smoking articles such as cigarettes, cigars and the like burn tobacco during use to create tobacco smoke. Alternatives to these types of articles, release compounds without burning to form an inhalable medium.

Examples of such products are heating devices include e-cigarette/heat-not-burn hybrid devices, also known as electronic tobacco hybrid devices. These hybrid devices contain a vapor or aerosol precursor (such as a liquid or gel) which is vaporized by heating to produce an inhalable vapor or aerosol. The vapor precursor may contain flavorings and/or aerosol-generating substances, such as glycerol and in some instances, nicotine. The vapor or aerosol passes through a substrate material in the device and entrains one or more constituents of that substrate material to produce the inhaled medium. The substrate material may be, for example, tobacco, other non-tobacco products or a combination, such as a blended mix, which may or may not contain nicotine. An example of an electronic tobacco hybrid device is disclosed in WO2016/135331.

SUMMARY

In some embodiments described herein, the disclosure provides a device for generating an inhalable medium, the device comprising:

- a container retaining a first volatilizable material;
- a heater for volatilizing the first volatilizable material held in the container;
- a chamber containing aerosolizable material comprising nicotine;
- a reservoir containing a basic solution; and
- an outlet;
- the arrangement being such that in use, the basic solution is released from the reservoir and enters the chamber containing the aerosolizable material, and the first volatilizable material is volatilized by the heater to form a vapor and/or an aerosol, which passes through the chamber containing aerosolizable material and entrains one or more constituents of the aerosolizable material, thereby forming an inhalable medium which passes through the outlet.

The device described herein may be referred to as an electronic tobacco hybrid device.

In some embodiments described herein, the disclosure provides a cartridge for use in a device for generating an inhalable medium, the cartridge comprising (i) a first volatilizable material in a container, (ii) an aerosolizable material comprising nicotine in a chamber, and (iii) a basic solution contained in a reservoir, the cartridge being configured such that in use, the basic solution is released from the reservoir and enters the chamber containing the aerosolizable material, and a vapor and/or an aerosol generated from the first volatilizable material passes through the chamber containing an aerosolizable material and entrains one or more constituents of the aerosolizable material.

Suitably, the cartridge may be adapted for use in the device for generating an inhalable medium described herein.

In some embodiments described herein, the disclosure provides kit comprising:

- (i) a first pod containing a first volatilizable material; and
- (ii) a second pod having (a) a chamber containing an aerosolizable material comprising nicotine, and (b) a reservoir containing a basic solution;
- wherein the first and second pods are configured for use in a device such that in use, the basic solution is released from the reservoir and enters the chamber containing the aerosolizable material, and a vapor and/or an aerosol generated from the first volatilizable material passes through the aerosolizable material and entrains one or more constituents of the aerosolizable material.

Further features and advantages of the disclosure will become apparent from the following description of preferred embodiments of the disclosure, given by way of example only.

BRIEF DESCRIPTION OF THE DRAWING

Embodiments of the invention are described, by way of example only, with reference to FIG. 1, which is a schematic cross-sectional view of a hybrid system comprising a first volatilizable material, an aerosolizable material in a chamber, and a reservoir containing a basic solution.

DETAILED DESCRIPTION

Tobacco can be treated with base and water in order to ease liberation of nicotine from the tobacco. Nicotine is liberated from nicotine salts in tobacco by reaction with the base. Nicotine is then volatilized at a lower temperature in use.

The inventors have determined that if base-treated tobacco is used in known electronic tobacco hybrid devices, nicotine delivery per puff significantly drops during use. The reaction between base and nicotine occurs quickly; the pH-treated nicotine is then is liberated quickly and delivery during consumption may reduce from puff to puff. The inventors have also observed that nicotine from base-pH-treated tobacco may be lost from the device prior to use due to its high volatility.

The present disclosure provides improved consistency of nicotine delivery per puff through delaying pH-treatment of the tobacco. The disclosure provides a basic solution in a reservoir, wherein the basic solution is introduced into the chamber containing the nicotine-containing material in use. The basic solution may, in some cases, be introduced into the chamber containing the nicotine-containing material at the beginning of the consumption period (i.e. before the first puff); this prevents losses of pH-treated nicotine prior to use. In some other cases, the basic solution may be introduced into the chamber containing the nicotine-containing material during the consumption period (i.e. during puffing); this prevents losses of pH-treated nicotine prior to use, and the rate of introduction can be limited to control the rate of pH treatment of the material and therefore control the rate of nicotine liberation by the pH treatment, providing more sustained nicotine delivery to the user.

Moreover, high-pH treatment of tobacco (which is an aerosolizable material comprising nicotine) results in the liberation of ammonia. Control of the rate of basic pH treatment controls the rate of release of ammonia, and this can improve the organoleptic properties of the tobacco (since the smell of ammonia is less strong).

In some cases, the disclosure provides a device for generating an inhalable medium, the device comprising:

a first volatilizable material;

a chamber containing aerosolizable material comprising nicotine;

a reservoir containing a basic solution; and an outlet;

the arrangement being such that in use, the basic solution is released from the reservoir and enters the chamber containing the aerosolizable material, and the first volatilizable material is volatilized by a heater to form a vapor and/or an aerosol, which passes through the chamber containing aerosolizable material and entrains one or more constituents of the aerosolizable material, thereby forming an inhalable medium which passes through the outlet.

The device described herein may be referred to as an electronic tobacco hybrid device. The vapor and/or aerosol typically entrains organic and other compounds or constituents from the aerosolizable material that have organoleptic properties, thus imparting flavor to the aerosol or vapor as it passes to the outlet.

FIG. 1 shows a cross-sectional view of an article for generating an inhalable medium. The article 1 has a chamber 2 which contains the aerosolisable material 3. The article 1 also has a reservoir 4 containing a basic solution 5 that may be released into the chamber 2 containing the aerosolisable material 3 in use. The inhalable medium that is generated by heating the volatilizable material leaves the article via the outlet 6.

In some cases, the aerosolizable material comprising nicotine may be porous, such that an aerosol or vapor can pass through the material. Thus, components of the aerosolizable material are efficiently entrained in the aerosol/vapor as it passes through the material.

The aerosolizable material comprising nicotine may typically be a solid material. In some cases, it may comprise a tobacco material, which may also be referred to as a tobacco composition. Discussion herein specifically relating to the pH-treatment of a tobacco material is explicitly disclosed in combination with any aerosolizable material comprising nicotine, to the extent that they are compatible.

As used herein, the term "tobacco material" refers to any material comprising tobacco or derivatives therefore. The term "tobacco material" may include one or more of tobacco, tobacco derivatives, expanded tobacco, reconstituted tobacco or tobacco substitutes. The tobacco material may comprise one or more of ground tobacco, tobacco fiber, cut tobacco, extruded tobacco, tobacco stem, reconstituted tobacco, agglomerated tobacco, spheronised tobacco and/or tobacco extract.

The tobacco used to produce tobacco material may be any suitable tobacco, such as single grades or blends, cut rag or whole leaf, including Virginia and/or Burley and/or Oriental. It may also be tobacco particle 'fines' or dust, expanded tobacco, stems, expanded stems, and other processed stem materials, such as cut rolled stems. The tobacco material may be a ground tobacco or a reconstituted tobacco material. The reconstituted tobacco material may comprise tobacco fibers, and may be formed by casting, a Fourdrinier-based paper making-type approach with back addition of tobacco extract, or by extrusion.

The aerosolizable material comprising nicotine may additionally comprise flavorings and/or aerosol generating agents.

The aerosolizable material comprising nicotine may additionally comprise one or more casings, such as invert sugar, molasses, cane sugar, honey, cocoa, liquorice, polyols such as glycerol and propylene glycol and acids such as malic acid.

The aerosolizable material may additionally comprise one or more binders, such as alginates, celluloses or modified celluloses, starches or modified starches, or natural gums. In some embodiments, the aerosolizable material comprises an alginate such as sodium alginate, calcium alginate, potassium alginate or ammonium alginate.

The aerosolizable material may additionally comprise one or more fillers. Suitably, the filler may comprise an inorganic material such as calcium carbonate, perlite, vermiculite, diatomaceous earth, colloidal silica, magnesium oxide, magnesium sulphate and magnesium carbonate. In some cases, the filler comprises chalk. Suitably, the filler may comprise an organic material such as wood pulp, cellulose and cellulose derivatives.

Suitably, the aerosolizable material comprising nicotine (prior to use) may have a pH of less than about 7, as measured according to the CORESTA protocol for measuring the pH of tobacco.

The device comprises a container which retains a first volatilizable material which can be volatilized in use to form a vapor and/or an aerosol. The first volatilizable material may alternatively be referred to as a vapor/aerosol precursor. The first volatilizable material may, in some cases, comprise a gel or liquid. Suitably, the first volatilizable material comprises, substantially consists of or consists of a liquid. Suitable liquids include components conventionally used in e-cigarette liquids.

The first volatilizable material may comprise aerosol-generating agents, such as propylene glycol and/or glycerol. Additionally, it may in some cases comprise flavorings. The material is typically volatilized at around 100-300° C., suitably at around 150-250° C.

In some cases, the first volatilizable material does not contain nicotine.

The basic solution may, in some cases, comprise an aqueous solution of sodium hydroxide, potassium hydroxide, calcium hydroxide, sodium hydrogen carbonate, potassium hydrogen carbonate, calcium hydrogen carbonate, sodium carbonate, potassium carbonate, calcium carbonate or mixtures thereof, or other GRAS water-soluble bases.

The pH-treatment of the aerosolizable material comprising nicotine may raise the pH of that material to more than about 7 (as measured according to the CORESTA protocol for measuring the pH of tobacco). Suitably, the pH of the treated material may be less than about 11. Suitably, the pH may be between about 8 and 9.

The basic solution is retained in a reservoir. The reservoir is, in some cases, is located outside of the chamber containing the aerosolizable material and outside of the container retaining a first volatilizable material.

In some cases, the basic solution is retained in the reservoir prior to use by a barrier material which is ruptured in use to release the basic solution. The barrier material may be ruptured by any suitable mechanism. For example, the barrier material may be pierced by a piercing member. The user may actuate the piercing member, or it may be that insertion of the reservoir into the device causes the piercing member to rupture the barrier. In other cases, the barrier material may be one that melts, decomposes, reacts, degrades, swells, dissolves or deforms to release the base at a temperature above room temperature but at or below the temperature reached during use. For instance, the barrier material may be selected from a polysaccharide or cellulosic barrier material, a gelatin, a gum, a gel, a wax or a mixture thereof. In some cases, the encapsulating material is selected from one or more of alginates, dextran, maltodextrin, cyclodextrin, pectin, methyl cellulose, ethyl cellulose, hydroxyethyl cellulose, hydroxypropyl cellulose, carboxymethyl cellulose, cellulose ethers, gum Arabic, gum ghatti, gum tragacanth, Karaya, locust bean, acacia gum, guar, quince seed, xanthan gums, agar gel, agarose gel, carrageenans, furoidan, furcellaran and carnauba wax.

In some cases, the basic solution may be pumped from the reservoir into the chamber in use. In some cases, the pump may be actuated by the user. The pump may, in some cases, be mechanically operated and responsive to an input of the user. The pump may, in some cases, be electrically operated and responsive to the device control circuitry. Such an electrically operated pump may be responsive to a user input (e.g. pressing a button or the like) or may be puff actuated (i.e. responsive to a puff sensor). In some other cases, the pump may be a passive (e.g. a turbine or form of diaphragm) and may be configured to pump the basic solution in response to a pressure differential caused by a user puff.

In some cases, the basic solution may be transferred to the aerosolizable material prior to the first puff; this prevents losses of pH-treated nicotine prior to use. In some other cases, the basic solution may be introduced into the chamber containing the nicotine-containing material during the consumption period (i.e. during puffing); this prevents losses of pH-treated nicotine prior to use. Moreover, staggered release (e.g. to coincide with each puff) of the basic solution means that the rate of pH treatment of the material is controlled and therefore control the rate of nicotine liberation by the pH treatment, providing more sustained nicotine delivery to the user.

In some cases, the device heats the aerosolizable material comprising nicotine in use, encouraging release of material components into the inhaled medium. In some cases, one heater may heat both the first volatilizable material and the aerosolizable material comprising nicotine. In some cases, a second heater may be provided which heats the aerosolizable material comprising nicotine. In some cases, the device does not heat the aerosolizable material comprising nicotine, relying on heat carried by the vapor/aerosol to warm the aerosolizable material (thereby volatilizing components of the aerosolizable material which are then entrained in the vapor/aerosol flow).

In an embodiment, the device comprises a cooler or cooling zone downstream of the heater and upstream of the chamber containing aerosolizable material comprising nicotine, the cooler or cooling zone being arranged to cool vaporized material to form an aerosol of liquid droplets which in use passes through the aerosolizable material in the chamber. The cooler may be arranged in effect to act as a heat exchanger, allowing for recovery of heat from the vapor. The recovered heat can be used for example to pre-heat the aerosolizable material and/or to assist in heating the first volatilizable material.

In an embodiment, the device is battery-operated. The battery may be a rechargeable battery or a disposable battery.

In an embodiment, the or each heater is an electrically resistive heater, such as a nichrome resistive heater, a ceramic heater etc. The heater may be for example a wire, which may for example be in the form of a coil, a plate (which may be a multi-layer plate of two or more different materials, one or more of which may be electrically conductive and one or more of which may be electrically non-conductive), a mesh (which may be woven or non-woven for example, and which again may be similarly multi-layer), a film heater, etc. Other heating arrangements may be used, including non-electrical heating arrangements. In some cases, the heater may comprise an inductive heater.

In an embodiment, the container holding the first volatilizable material is removable. The container may be in the form of a pot or the like (which in some embodiments may be annular for example), and/or an absorbent wadding or the like. The container may in effect be a disposable item which is replaced as a whole after use. As an alternative, the arrangement may be such that the user removes the container from the device, replaces used volatilizable material or tops up the material in the container, and then places the container back in the device.

In some cases, the container may be non-removable from the device. In such an embodiment, the user may just replace used material or top up material in the container after use as necessary.

In some cases, the container and the chamber are an integral unit. In some cases, the integral unit is a cartridge that can be removed from the device.

In some cases, the chamber is removable from the device. The chamber may be, for example, in the form of a cartridge or the like which contains the aerosolizable material comprising nicotine before use. The whole chamber containing the aerosolizable material comprising nicotine may in effect be a disposable item which is replaced as a whole after use. As an alternative, the arrangement may be such that the user removes the chamber from the device, replaces used material in the chamber, and then places the chamber back in the device.

In some cases, the reservoir containing the basic solution is removable from the device. It may in effect be a disposable item which is replaced as a whole after use. As an alternative, the arrangement may be such that the user removes the reservoir from the device, tops up the basic solution, and then places the reservoir back in the device. In some other cases, the reservoir may be non-removable from the device. In such cases, the user may just top up the solution in the reservoir after use as necessary.

In some cases, the reservoir and container are an integral unit. In some cases, the reservoir and the chamber are an integral unit. In some cases, the reservoir, container and chamber are an integral unit, which may be a cartridge that can be removed from the device.

In some embodiments described herein, the disclosure provides a cartridge for use in a device for generating an inhalable medium, the cartridge comprising (i) a first volatilizable material in a container, (ii) an aerosolizable material comprising nicotine in a chamber, and (iii) a basic solution contained in a reservoir, the cartridge being configured such that in use, the basic solution is released from the reservoir and enters the chamber containing the aerosolizable material, and a vapor and/or an aerosol generated from the first volatilizable material passes through the chamber containing an aerosolizable material and entrains one or more constituents of the aerosolizable material. Suitably, the cartridge may be adapted for use in the device for generating an inhalable medium described herein.

To the extent that they are compatible, features described in relation to the device are explicitly disclosed in combination with the cartridge and vice versa. Specifically, features of the aerosolizable material comprising nicotine or volatilizable material described herein are explicitly disclosed in combination with the device and cartridge embodiments of the disclosure.

As used herein, "aerosol generating agent" refers to a compound or mixture that promotes the generation of an aerosol. An aerosol generating agent may promote the generation of an aerosol by promoting an initial vaporization and/or the condensation of a gas to an inhalable solid and/or liquid aerosol.

In general, any suitable aerosol generating agent or agents may be included in the aerosol generating material of the disclosure. Suitable aerosol generating agents include, but are not limited to: a polyol such as sorbitol, glycerol, and glycols like propylene glycol or triethylene glycol; a non-polyol such as monohydric alcohols, high boiling point hydrocarbons, acids such as lactic acid, glycerol derivatives, esters such as diacetin, triacetin, triethylene glycol diacetate, triethyl citrate or myristates including ethyl myristate and isopropyl myristate and aliphatic carboxylic acid esters such as methyl stearate, dimethyl dodecanedioate and dimethyl tetradecanedioate.

As used herein, the terms "flavor" and "flavoring" refer to materials which, where local regulations permit, may be used to create a desired taste or aroma in a product for adult consumers. They may include extracts (e.g., liquorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus *Mentha*), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

For the avoidance of doubt, where in this specification the term "comprises" is used in defining the invention or features of the invention, embodiments are also disclosed in which the invention or feature can be defined using the terms "consists essentially of" or "consists of" in place of "comprises".

The above embodiments are to be understood as illustrative examples of the invention. Further embodiments of the invention are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilized and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. An article for generating an inhalable medium, the article comprising:

a first volatilisable material;

a chamber containing aerosolisable material comprising nicotine;

a reservoir containing a basic solution; and an outlet;

the arrangement being such that in use, the basic solution is released from the reservoir and enters the chamber containing the aerosolisable material, and the first volatilisable material is volatilised by a heater to form a vapour and/or an aerosol, which passes through the chamber containing aerosolisable material and entrains one or more constituents of the aerosolisable material, thereby forming an inhalable medium which passes through the outlet.

2. An article according to claim 1, wherein the first volatilisable material comprises a liquid or gel.

3. An article according to claim 1, wherein the basic solution comprises an aqueous solution of sodium hydroxide, potassium hydroxide, calcium hydroxide, sodium hydrogen carbonate, potassium hydrogen carbonate, calcium hydrogen carbonate, sodium carbonate, potassium carbonate, calcium carbonate or mixtures thereof, or other soluble bases.

4. An article according to claim 1, wherein basic solution is retained in the reservoir prior to use by a barrier material which is ruptured in use to release the basic solution.

5. An article according to claim 1, wherein the basic solution is pumped from the reservoir into the chamber in use.

6. An article according to claim 5, wherein the pump is puff-actuated.

7. An article according to claim 1, wherein the first volatilisable material does not contain nicotine.

8. An article according to claim 1, wherein the first volatilisable material is retained in a container.

9. An article according to claim 1, wherein the first volatilisable material comprises an aerosol-generating agent.

10. An article according to claim 9, wherein aerosol-generating agent comprises one or more of propylene glycol and glycerol.

11. An article according to claim 1, wherein the aerosolisable material additionally comprises one or more of flavouring.

12. An article according to claim 1, wherein the aerosolisable material comprises one or more casings.

13. An article according to claim 1, wherein the aerosolisable material comprises one or more polyols.

14. An article according to claim 1, wherein the aerosolisable material comprises one or more acid.

15. An article according to claim 1, wherein the aerosolisable material comprises one or more binders.

16. An article according to claim 15, wherein the aerosolisable material comprises an alginate.

17. An article according to claim 1, wherein the aerosolisable material additionally comprises one or more fillers.

18. An article according to claim 1, wherein, prior to use, the aerosolisable material comprising nicotine has a pH of less than about 7, as measured according to the CORESTA protocol for measuring the pH of tobacco.

19. An assembly for generating an inhalable medium, the assembly comprising:

an article according to claim 1: and a heater for volatilising the first volatilisable material.

* * * * *